US006365809B1

(12) United States Patent
Steinberger

(10) Patent No.: US 6,365,809 B1
(45) Date of Patent: Apr. 2, 2002

(54) TUNING POST FOR STRINGED MUSICAL INSTRUMENT

(76) Inventor: Richard Ned Steinberger, 420 Hill Top Rd., Nobleboro, ME (US) 04555

( * ) Notice: Subject to any disclaimer, the term of this patent is extended or adjusted under 35 U.S.C. 154(b) by 0 days.

(21) Appl. No.: 09/563,877

(22) Filed: May 3, 2000

(51) Int. Cl.[7] ..... G10D 3/121
(52) U.S. Cl. ..... 84/304; 84/305; 84/306
(58) Field of Search ..... 84/304, 305, 306

(56) References Cited

U.S. PATENT DOCUMENTS 4,970,930 A * 11/1990 Secord ..... 84/306
5,097,736 A * 3/1992 Turner ..... 84/304
5,767,427 A * 6/1998 Corso ..... 84/306
5,847,295 A * 12/1998 Klepacki ..... 84/305

* cited by examiner

*Primary Examiner*—Robert E. Nappi
*Assistant Examiner*—Kim Lockett
(74) *Attorney, Agent, or Firm*—Saul Epstein

(57) ABSTRACT

A tuning post for a stringed musical instrument which includes an integral string severing mechanism which automatically severs the excess length of a string while the string is being tensioned. A sharp edged aperture in the string post through which the excess string protrudes cooperates with a stationary sharp cutting edge to sever the string while the post is being turned during the initial tuning operation.

5 Claims, 2 Drawing Sheets

TUNING POST FOR STRINGED MUSICAL INSTRUMENT

BACKGROUND OF THE INVENTION

This invention relates to stringed musical instruments, primarily, but not exclusively to those in the lute family. In particular, the invention concerns a new and improved tuning post for such instruments.

Each string of a stringed musical instrument, as for example, a guitar, is ordinarily stretched between a fixed point near the tail of the instrument, and an adjustable tuning post at the other end. The tuning post provides the necessary mechanism to adjust an the tension of the string so as to cause it to resonate at the desired frequency. As many tuning posts are required as there are strings on the instrument.

There are several methods in common use to fasten strings to the tuning post. According to one popular construction, when a string is installed, it is first fastened to the instrument at the tail, and then the free end is inserted through a hole in the tuning post, where it is clamped. The tuning post is then turned (usually through a worm gear drive) until the tension in the string is high enough to produce the desired note. Or, the string may be simply wrapped around the tuning post without clamping, relying on friction to keep the string from slipping. With any construction in general use, the free end of the string at this point projects out of the post, and must either be manually cut off, or left as an unsightly tail. Not only is a projecting tail unsightly, but it can be dangerous in the sense that it is common for the end of a projecting string to pierce a user's finger or to rip the lining of the instrument case. Obviously, a projecting string end should be avoided.

Inasmuch as string replacement may be required during the course of a performance, it is desirable that means be available to conveniently and rapidly effectuate the cutting off of excess string. It is also desirable that no tools be required.

Accordingly, it is an object of the present invention to provide a string cutoff mechanism which automatically severs excess string projecting from the tuning post as the post is turned to tighten the string, without requiring tools.

SUMMARY OF THE INVENTION

The foregoing object of the invention is accomplished by providing a sharp edged aperture in a rotatable string post out of which a newly installed string protrudes and also providing a sharp cutter surface which abuts the aperture. Rotating the string post causes the edge of the aperture to pass the edge of the abutting cutter surface, severing the string with a scissors-like action. Continuing to rotate the string post causes the string to be tensioned such that it vibrates at the desired frequency.

A more detailed explanation of the invention may be had by reference to the following detailed description, which should be read in conjuction with the appended drawings.

DETAILED DESCRIPTION OF THE INVENTION

Figure 1:
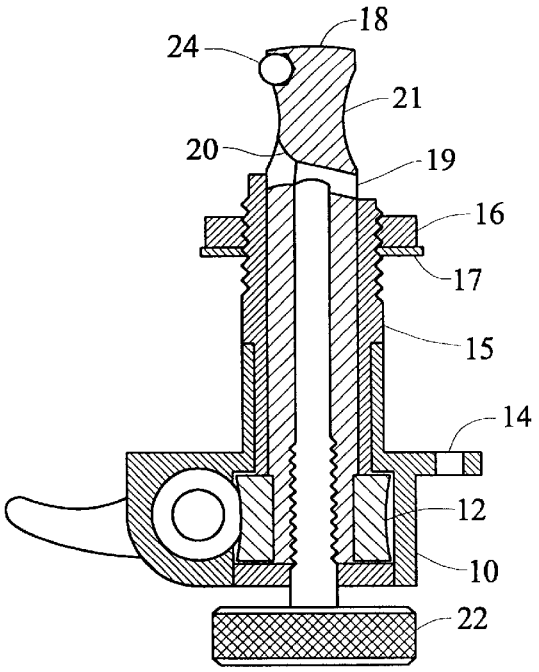
FIG. 1 is a cross sectional side view of a first embodiment of the present invention. The view is taken at 1—1 of FIG. 3.

The present invention relates to a tuning post which not only allows string tension to be adjusted, as has been done in the prior art, but also automatically severs excess string when the string is initially tensioned. In accordance with a first preferred embodiment of the invention, the invented tuning post includes a conventional housing 10 which holds a worm mesh comprised of worm 11 and wormgear 12. The worm mesh is driven by handle 13. The housing 10 preferably includes a hole 14, which allows the tuning post to be fastened to the instrument neck (not shown) by a screw. A screw through hole 14 will prevent the housing from rotating when the string is being tensioned.

A hardened cylindrical sleeve 15 is held securely to the housing 10, as by being pinned, or otherwise held from turning. The sleeve is threaded at its free end to accept a nut 16 and washer 17. The sleeve is inserted through a hole in the instrument neck, and the tuning post is secured to the neck by nut 16.

A preferably hardened string post 18 passes through a longitudinal bore in sleeve 15. The string post is securely fastened to wormgear 12 by, for example, pressing or brazing. A cross hole 19 is drilled through the string post at an angle, with a chamfer at the high end of the hole, tilted at an even greater angle. The end of hole 19 opposite the chamfer is sharp. The string post 18 is drilled and tapped longitudinally to receive clamp screw 22. The top end of clamp screw 22 is preferably rounded and crosses the hole 19. The clamp screw 22 is used to clamp the string against the top surface of hole 19. A portion of the string post above the hole 19 is necked down in a smooth curve to define an area 21 for the string to wind. As an aid to orienting the string post when installing a string, and to indicate to the user the proper side of the string post to insert the string, a small ball 24 is attached to the top of the string post in line with the chamfer 20.

Figure 2:
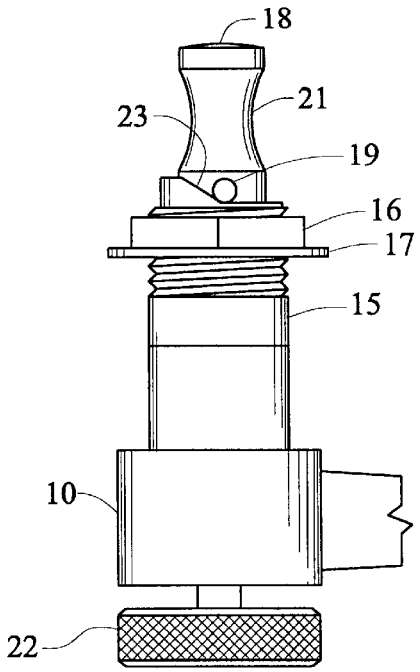
FIG. 2 is a side view 90° from the view of FIG. 1.
Figure 3:
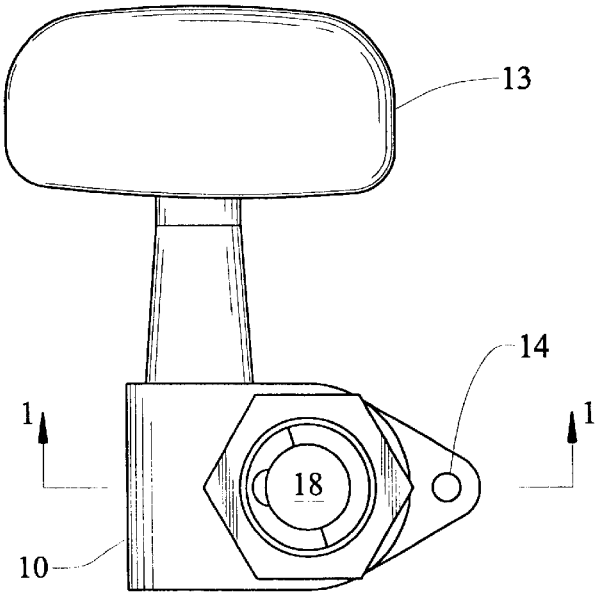
FIG. 3 is a top view of the embodiment of FIG. 1.
Figure 4:
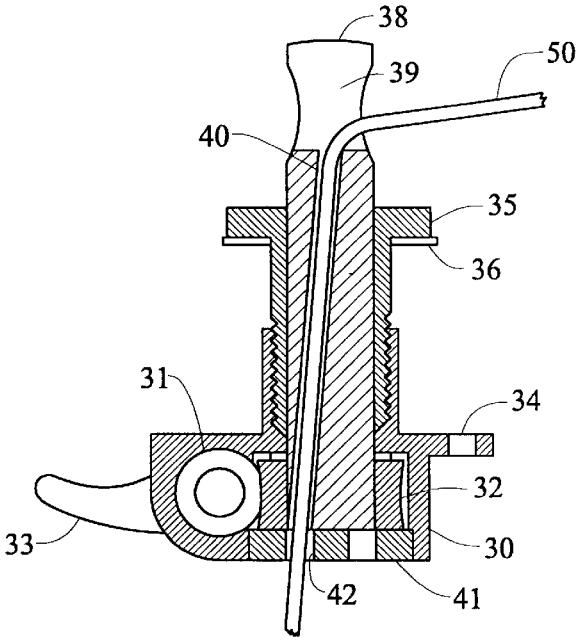
FIG. 4 is a cross sectional side view of a second embodiment of the invention. The view is taken at 4—4 of FIG. 7.
Figure 5:
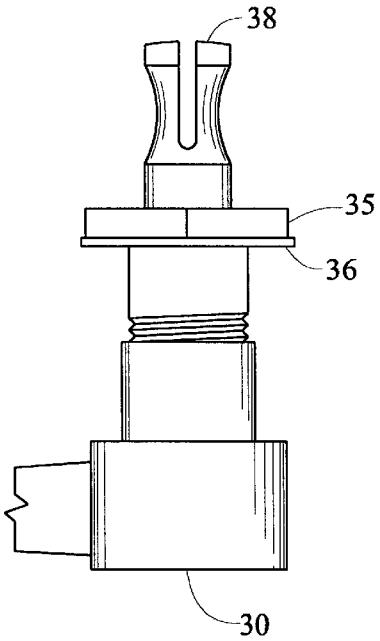
FIG. 5 is a side view 90° from FIG. 4.
Figure 6:
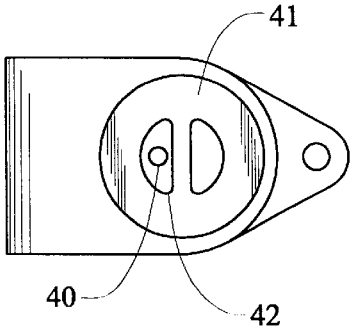
FIG. 6 is a bottom view of the embodiment of FIG. 4.
Figure 7:
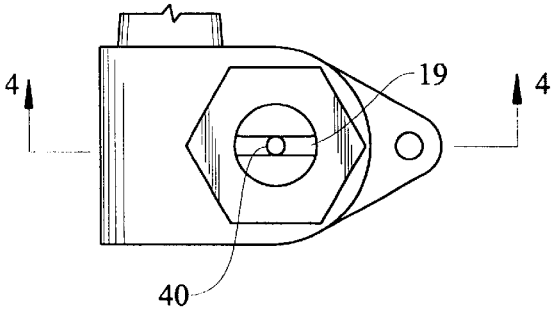
FIG. 7 is a top view of the embodiment of FIG. 4.

As can best be seen in FIG. 2, the sleeve 15 includes a preferably angled cutter surface 23. The cutter surface 23 is intended to cooperate with an edge of hole 19 to cut the string as the string post 18 is turned while the string is being tensioned. The cutter surface need not be angled as shown, however, with an angled surface, the cutting forces are reduced. The top surface of the sleeve 15 is low enough to not engage a string entering hole 19 through chamfer 20.

When a string is installed, it is first securely attached to the instrument body at the tail, and then the free end is inserted through hole 19 from the chamfered end and pulled through. The string is clamped in the hole by turning clamp screw 22, with the free end of the string protruding from the sharp end of the hole. Handle 13 is then rotated such that the string post turns to tension the string. As the hole 19 passes the cutter surface 23, excess string is automatically severed, and further turning of handle 13 causes the tension in the string to be increased until it is properly tensioned.

FIGS. 4 through 7 illustrate a second embodiment of the invention. The tuning post of the second embodiment includes a housing 30, worm 31, wormgear 32, handle 33, and hole 34, similar to the housing 10, worm 11, wormgear 12, handle 13, and hole 14 of the first embodiment. Instead of being held to the instrument neck by sleeve 15 and nut 16, as in the first embodiment, a threaded bushing 35 engages threads in the neck of the housing 30, holding the assembly in place. A washer 36 prevents the hexagonal portion of bushing 35 from marring the instrument neck during installation.

A preferably hardened string post 38 is securely held to wormgear 32 and passes through a bore in bushing 35. The top of the string post is slotted with slot 39, and a longitudinal hole 40 is drilled through so that it emerges from the bottom of the string post near the periphery. The hole, which is to serve as a passageway for a string, is preferably, but not necessarily, angled. Instead of a longitudinal hole, a longitudinal slot down the side of the string post from the slot 39 to the bottom end of the string post could also be used to serve as a string passageway. A preferably hardened cutter plate 41 is secured to the bottom of the housing 30, as by knurling and pressing in. Cutter plate 41 includes at least one opening 42, through which a string can pass.

In use, a string (50) is inserted into slot 39 and hole 40, and the end pulled through. The handle 33 is then turned to tighten the string. As the string post is turned, the string is severed by the edge of opening 42 acting against the edge of hole 40. Further turning of the string post tensions the string as desired.

I claim:

1. A tuning post for stringed musical instruments which comprises:

a stationary sleeve secured to said musical instrument;

a rotatable string post within said sleeve, said string post including a sharp edged aperture therethrough large enough to pass a string;

a sharp edged cutting element attached to said sleeve, the sharp edge of said cutting element engaging said sharp edge of said string post aperture with a scissors-like action as said string post is turned; and means for turning said string post with respect to said cutting element.

2. A tuning post as recited in claim 1 and further including a threaded string clamping member coaxial with said string post and intersecting said aperture.

3. A tuning post as recited in claim 2 wherein the end of said clamping member intersecting said aperture is rounded.

4. A tuning post as recited in claim 1 wherein said aperture is comprised of a cross hole in said string post at an angle whereby the end of said aperture having said sharp edge will be occluded by said cutting element as said string post is turned, but the other end of said aperture will not.

5. A tuning post as recited in claim 4 wherein said string post further includes a necked down region, the end of said aperture opposite said sharp edge intersecting the surface of said string post in said necked down region.

* * * * *